US008800676B2

(12) United States Patent
Guo et al.

(10) Patent No.: US 8,800,676 B2
(45) Date of Patent: Aug. 12, 2014

(54) HAND-HELD AEROSOL FIRE SUPPRESSION APPARATUS

(75) Inventors: Hongbao Guo, Xi'An (CN); Kun Zhang, Xi'An (CN); Chunjie Ma, Xi'An (CN); Tengfei Zhai, Xi'An (CN); Zhenping Deng, Xi'An (CN)

(73) Assignee: Shaanxi J & R Fire Fighting Co., Ltd., Xi'an (CN)

( * ) Notice: Subject to any disclaimer, the term of this patent is extended or adjusted under 35 U.S.C. 154(b) by 0 days.

(21) Appl. No.: 13/375,470

(22) PCT Filed: Jul. 3, 2010

(86) PCT No.: PCT/CN2010/074961
§ 371 (c)(1),
(2), (4) Date: Nov. 30, 2011

(87) PCT Pub. No.: WO2011/091652
PCT Pub. Date: Aug. 4, 2011

(65) Prior Publication Data

US 2012/0279733 A1 Nov. 8, 2012

(30) Foreign Application Priority Data

Jan. 26, 2010 (CN) ..... 2010 2 0102303

(51) Int. Cl.
*A62C 13/00* (2006.01)
*A62C 5/00* (2006.01)

(52) U.S. Cl.
CPC ..... *A62C 5/006* (2013.01); *A62C 13/003* (2013.01)
USPC ..... 169/71; 169/30; 169/75

(58) Field of Classification Search
CPC ..... A62C 5/006; A62C 13/22; A62C 13/003
USPC ..... 169/46, 71, 84, 230, 231, 30, 75; 239/102.1, 102.2, 256, 288.3–288.5, 239/459, 567, 594, 601
See application file for complete search history.

(56) References Cited

U.S. PATENT DOCUMENTS 871,147 A 11/1907 Shafer
5,678,637 A * 10/1997 O'Connell ..... 169/46

(Continued)

FOREIGN PATENT DOCUMENTS

| | | |
|---|---|---|
| CN | 2339247 | 9/1999 |
| EP | 1484088 | 12/2004 |
| WO | 0037142 | 5/2000 |

OTHER PUBLICATIONS

European Patent Office, Extended European Search Report on EP Appln. No. 10844429.0, dated May 27, 2013.

*Primary Examiner* — Jason Boeckmann
(74) *Attorney, Agent, or Firm* — Studebaker & Brackett PC

(57) ABSTRACT

The present invention relates to a novel hand-held aerosol fire suppression apparatus, comprising thermal insulating layer (3), inner cylinder (4), aerosol generating agent (5), heat insulating material (6), jet nozzle (9), tapered jet orifice (10), enclosure (11), ignition head (12) and piezoelectric crystal assembly (13), wherein the thermal insulating layer (3) is arranged between the inner cylinder (4) and the aerosol generating agent (5), and the jet nozzle (9) is screwed to the enclosure (11) by means of a thread structure that comprises 3~6 thread segments. Compared to that in the prior art, with the segment thread design for screwing the jet nozzle to the enclosure, the time required for removing the jet nozzle can be reduced significantly, and therefore the apparatus in the present invention has much better safety feature against accidents.

8 Claims, 3 Drawing Sheets

(56) References Cited

U.S. PATENT DOCUMENTS

| | | | | |
|---|---|---|---|---|
| 6,142,519 | A * | 11/2000 | Smith | 280/741 |
| 6,601,777 | B2 * | 8/2003 | Sun et al. | 239/102.1 |
| RE39,767 | E * | 8/2007 | Soule et al. | 239/468 |
| 7,766,259 | B2 * | 8/2010 | Feith et al. | 239/391 |
| 2003/0127535 | A1 * | 7/2003 | Adiga et al. | 239/102.1 |
| 2006/0278409 | A1 * | 12/2006 | Blau et al. | 169/26 |
| 2007/0068683 | A1 * | 3/2007 | Pavesi | 169/46 |
| 2007/0079972 | A1 * | 4/2007 | Gross | 169/46 |

* cited by examiner

HAND-HELD AEROSOL FIRE SUPPRESSION APPARATUS

CROSS REFERENCE TO RELATED APPLICATIONS

This is a U.S. National Phase patent application of PCT/CN2010/074961, filed Jul. 3, 2010, which claims priority to Chinese Patent Application No. 201020102303.1, filed Jan. 26, 2010, each of which is hereby incorporated by reference in the present disclosure in its entirety.

FIELD OF THE INVENTION

The present invention belongs to the technical field of gas fire suppression, and relates to a novel hand-held aerosol fire suppression apparatus.

BACKGROUND OF THE INVENTION

In our working and living environments in modern times, fire hazard exists everywhere in limited spaces, such as machines, electrical devices, automobiles, electric cabinets, all kinds of household electric appliances, computers, TV sets, kitchens, etc., and spontaneous ignition of wires or engines often occur due to extremely high temperature. Usually, using a hand-held fire suppression apparatus to suppress such small-scale fire timely can get twice the result with half the effort. In recent years, the research on miniaturization of aerosol fire suppression apparatuses including introduction of them into fire suppression applications in small spaces (e.g., household electrical appliances) has been made actively in foreign countries, and much progress has been achieved. For example, the products introduced by Firecom (Italy) mainly for kitchens don't have cooling and heat insulation parts. The fire suppression products have the following major drawbacks: (1) The aerosol spurts out directly after the medical is ignited, the temperature at the jet orifice is as high as 1200° C., the flame length is up to 100 mm, and may cause scalding; (2) The handle doesn't have enough strength, and may deform when force is applied on it; in addition, the battery is difficult to install, and there is no way to judge whether the battery has to be replaced or not after the battery is used for a long time.

In view of the drawbacks in the prior art, the applicant solved the problem of high temperature at the jet orifice and risk of scalding in the prior patent application (Application No. 200920033448.8). For hand-held aerosol fire suppression apparatuses, it is crucial to eliminate the safety risk in all aspects, besides improving the fire suppression efficacy. There is more or less potential safety risk in all existing hand-held aerosol fire suppression apparatuses in the prior art.

SUMMARY OF THE INVENTION

In view of the present situation of the prior art, the object of the present invention is to provide a novel aerosol fire suppression apparatus, which is more reasonable in structure, has lower temperature at the jet orifice and shorter flame, and can release aerosol quickly, with safety protection integrated into the switch.

The technical solution of the present invention will be described in details as following:

A novel hand-held aerosol fire suppression apparatus, comprising thermal insulating layer, inner cylinder, aerosol generating agent, heat insulating material, jet nozzle, tapered jet orifice, enclosure, ignition head and piezoelectric crystal assembly, wherein the thermal insulating layer is arranged between the inner cylinder and the aerosol generating agent, and the jet nozzle is screwed to the enclosure by means of a thread structure that comprises 3~6 thread segments.

Furthermore, the apparatus comprises a triangular platen and a rear cap; wherein, the rear cap is screwed to the enclosure by means of thread, and has a V-shaped convex on one side, the V-shaped convex has a recess into which a bulge on the edge of the triangular platen can be fitted, the rear cap has a slot to receive a press bar on the bottom, the triangular platen is connected to the press bar via a shaft, and the press bar is connected to the rear cap via a shaft; the piezoelectric crystal assembly is installed in the rear cap, and one end of the piezoelectric crystal assembly corresponds to a safety plate on the other side of the rear cap.

Furthermore, the safety plate is an embedded cap installed on a rectangular opening on the other side of the rear cap, and can be destructed and then fall off when the press bar is turned.

Furthermore, the press bar has a boss on one side.

Furthermore, the fitting between the bulge on the edge of the triangular platen and the recess of the V-shaped convex can be convex-concave fitting.

Furthermore, the apparatus further comprises tabular coolant and cellular coolant; the tabular coolant is arranged between the aerosol generating agent and the cellular coolant.

Compared to that in the prior art, the advantages of the apparatus in the present invention include: (1) with the segmented thread design for screwing the jet nozzle to the enclosure, the time required for removing the jet nozzle can be reduced greatly, and therefore the safety feature against accidents is greatly improved; (2) with the concave-convex fitting between the bulge on the triangular platen and the recess on the rear cap, the hand-held aerosol fire suppression apparatus is kept in absolutely safe state, till the hand-held aerosol fire suppression apparatus is activated; in addition, the hand-held aerosol fire suppression apparatus can be activated simply by pressing the triangular platen with a thumb to slide the triangular platen out of the recess while pressing the boss with the hand to remove the safety plate. In that way, the original separate safety mechanism and switch mechanism are integrated; moreover, the apparatus is easy to operate and has a higher safety factor; (3) with the structure and assembly design of aerosol generating agent, tabular coolant, and cellular coolant in the apparatus, the aerosol can be released more smoothly, and the cooling effect is better.

DESCRIPTION OF REFERENCE NUMERALS FOR MAIN COMPONENTS OF THE DRAWINGS

1—triangular platen, 2—rear cap, 3—thermal insulating layer, 4—inner cylinder, 5—aerosol generating agent, 6—heat insulating material, 7—tabular coolant, 8—cellular coolant, 9—jet nozzle, 10—tapered jet orifice, 11—enclosure, 12—ignition head, 13—piezoelectric crystal assembly, 14—safety plate, 15—shaft, 16—press bar, 17—shaft, 18—bulge, 19—slot, 20—thread-less segment.

DETAILED DESCRIPTION OF THE EMBODIMENTS

The embodiments of the present invention will be further detailed with reference to the drawings.

Figure 1:
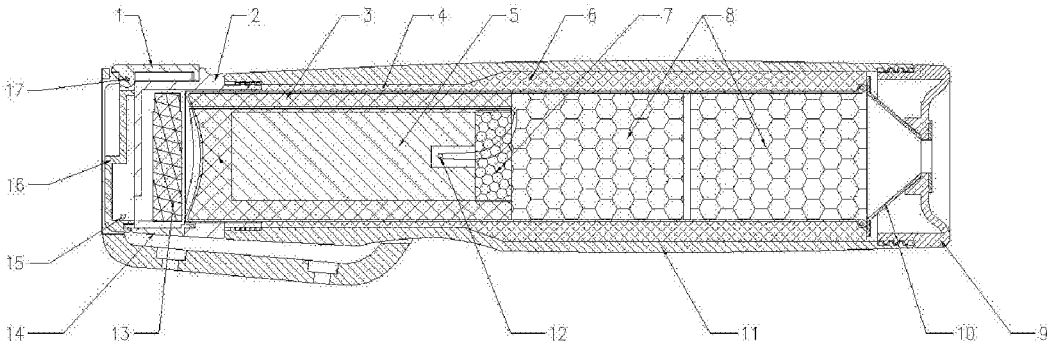
FIG. 1 is a schematic structural diagram of an example of the hand-held aerosol fire suppression apparatus in the present invention.

FIG. 1 is a schematic structural diagram of an example of the hand-held aerosol fire suppression apparatus in the present invention. As shown in FIG. 1, the hand-held aerosol fire suppression apparatus has a cylindrical enclosure 11 and an inner cylinder 4; in addition, the apparatus comprises rear cap 2, inner cylinder 4, aerosol generating agent 5 in the inner cylinder, ignition head 5 arranged at the center of the aerosol generating agent 5, tabular coolant 7, cellular coolant 8, tapered jet orifice 10, and jet nozzle 9; wherein the tabular coolant 7 is arranged between the aerosol generating agent 5 and the cellular coolant 8. The inner cylinder 4 is installed in the enclosure 11, and the rear cap 2 and jet nozzle 9 are screwed to the enclosure 11 respectively.

Moreover, a piezoelectric crystal assembly 13 is arranged between the rear cap 2 and the enclosure 11. The piezoelectric crystal assembly 13 is connected to an ignition loop in the system and is designed to initiate the ignition head 12.

Figure 2:
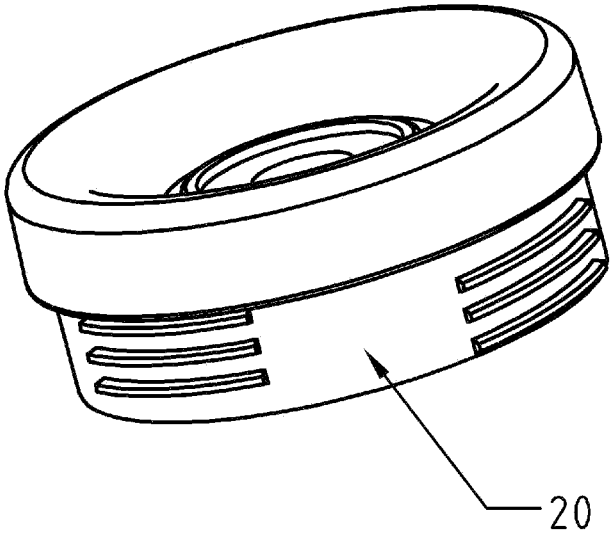
FIG. 2 is an enlarged diagram of the jet nozzle structure in the hand-held aerosol fire suppression apparatus in the present invention.

FIG. 2 is an enlarged diagram of the jet nozzle structure on the hand-held aerosol fire suppression apparatus in the present invention. As shown in FIG. 2, the jet nozzle structure has thread segments and thread-less segments 20; the thread structure for screwing the jet nozzle 9 to the enclosure 11 comprises 3~6 segments of thread. Of course, the segmented thread structure can be in any other structural form. With the segmented thread design for screwing the jet nozzle to the enclosure, the time required for removing the jet nozzle can be reduced significantly.

Figure 3:
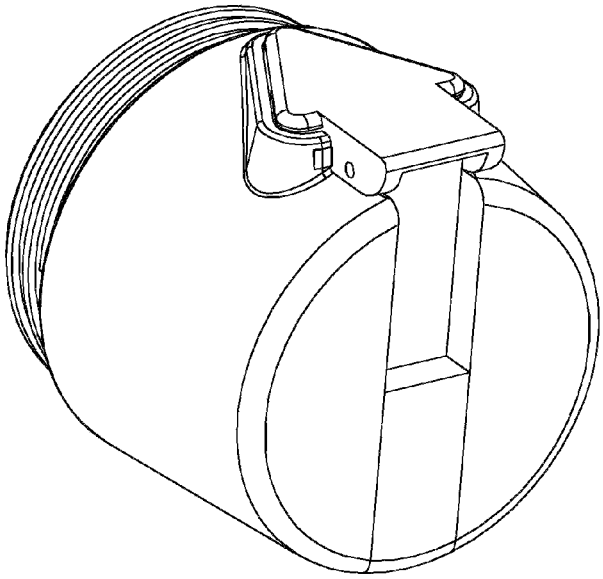
FIG. 3 is a three-dimensional structural diagram of the rear cap on the hand-held aerosol fire suppression apparatus in the present invention.
Figure 4:
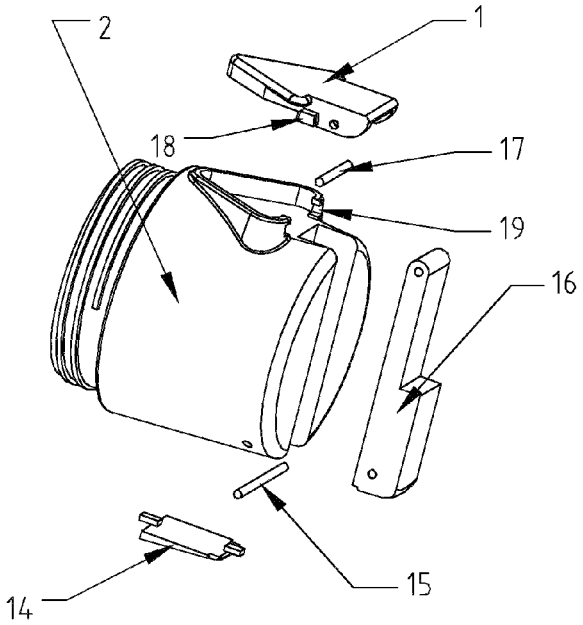
FIG. 4 is a three-dimensional exploded diagram of the rear cap on the hand-held aerosol fire suppression apparatus in the present invention.
Figure 5:
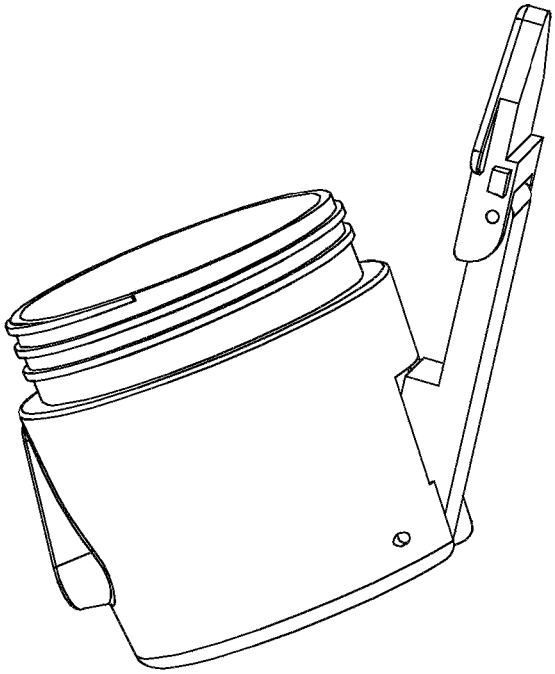
FIG. 5 is a three-dimensional diagram of the rear cap in open state on the hand-held aerosol fire suppression apparatus in the present invention.

The rear cap of the hand-held aerosol fire suppression apparatus in the present invention will be further detailed with reference to FIGS. 3, 4 and 5. FIG. 3 is a three-dimensional structural diagram of the hand-held aerosol fire suppression apparatus in the present invention, FIG. 4 is a three-dimensional exploded view of the rear cap on the hand-held aerosol fire suppression apparatus in the present invention, and FIG. 5 is a three-dimensional diagram of the rear cap in open state on the hand-held aerosol fire suppression apparatus in the present invention.

As shown in the drawings, in this embodiment the rear cap 2 comprises triangular platen 1, rectangular press bar 16 with a boss, and safety plate 14, wherein the rear cap 2 has a V-shaped convex on one side, the V-shaped convex has a recess 19 into which a bulge 18 on the edge of the triangular platen 1 can be fitted; the triangular platen 1 can be inlaid onto the rear cap via the V-shaped convex. The rear cap 2 has a rectangular opening on the top, and the press bar 16 can be inlaid into the rectangular opening.

The triangular platen 1, press bar 16 and rear cap 2 are connected together via shaft 17 and shaft 15; since both the press bar 16 and the triangular platen 1 can be inlaid onto the rear cap 2, the three parts can be assembled into one piece; furthermore, since they are connected via shafts, the triangular platen 1 can slide out of the recess 19 on the inner wall of the V-shaped convex on the rear cap 2 when the triangular platen 1 is pressed; at this point, the triangular platen 1 is connected to the press bar 16 via the shaft 17, and the press bar 16 can be turned around the shaft 15 to a certain degree. In this embodiment, the bulge 18 on the edge of the triangular platen 1 is fitted to the recess 19 in the V-shaped convex by concave-convex fitting; of course, alternatively, they can be fitted together by convex-concave fitting.

Now, the hand-held aerosol fire suppression apparatus in the present invention will be further detailed. A safety plate 14 is arranged on the lower end of the rear cap 2, corresponding to the piezoelectric crystal assembly 13 installed in the rear part 2; the safety plate 14 can be an embedded cap, and installed in the fore-mentioned rectangular opening. The safety plate 14 can be destructed and then fall off when the press bar 16 is turned, and thereby initiate the piezoelectric crystal assembly 13, which in turn initiates the ignition head 12.

To facilitate operation, the press bar 16 is designed with a rectangular boss, and the boss is on the side where the press bar 16 doesn't contact with the rectangular opening on the rear cap 2.

To use the apparatus, the operator can hold the apparatus at the slot on the main body, press down the triangular platen 1 gently with a thumb, so that the triangular platen 1 with the bulge 18 slides out of the recess 19 on the inner wall of the V-shaped convex on the rear cap 2; since the triangular platen 1 is connected to the press bar 16 via the shaft 17 and the press bar 16 is connected to the rear cap 2 via the shaft 15, the operator can turn the press bar 16 by an angle of 220~270 degrees around the shaft 15; thus the safety plate 14 is destructed and falls off; meanwhile, the operator can press down the piezoelectric crystal assembly 13, and thereby initiate the apparatus and ignite the aerosol generating agent 5.

When the apparatus operates, the generated aerosol passes through the tabular coolant 7 in the cellular ceramics material, where the flames are eliminated and the aerosol is cooled. Then the aerosol is accelerated through the tapered jet orifice 10, to meet the requirement for jet length. Cellular ceramic materials have intrinsic thermal storage and slag filtering features. An appropriate ceramic material can be selected to meet the demand for flame elimination and cooling. With the tapered jet orifice 10, the jet velocity of aerosol is increased, and thereby the jet length is increased effectively. With the segmented thread design for screwing the jet nozzle 9 to the enclosure 11, the jet nozzle 9 can be removed easily in case of any accident or the apparatus is jammed, so that the heat generated in the aerosol generation process can be exhausted quickly.

While the present invention is described as above in some examples, it should be understood that any change to the embodiments in the form or details don't have influence on the essentials and protective scope of the apparatus.

On the basis of the above instruction for the present invention, those skilled in the art can easily make modifications or variations to the examples without departing from the spirit of the present invention; however, all these modifications or variations shall be deemed as falling into the protective scope of the present invention. Those skilled in the art shall appreciate that the above description is only provided to elaborate and explain the object of the present invention, instead of constituting any confinement to the present invention. The protective scope of the present invention shall only be confined by the claims and their equivalence.

The invention claimed is:

1. A hand-held aerosol fire suppression apparatus, comprising a thermal insulating layer, an inner cylinder, an aerosol generating agent, a heat insulating material, a jet nozzle, a tapered jet orifice, an enclosure, an ignition head, a piezoelectric crystal assembly, a triangular platen and a rear cap; wherein the thermal insulating layer is arranged between the inner cylinder and the aerosol generating agent, and the let nozzle is screwed to the enclosure by means of a thread structure that comprises 3 to 6 thread segments; wherein the rear cap is screwed to the enclosure by means of thread, and has a V-shaped convex on one side, the V-shaped convex has a recess into which a bulge on the edge of the triangular platen can be fitted, the rear cap has a slot to receive a press bar on the bottom, the triangular platen is connected to the press bar via a shaft, and the press bar is connected to the rear cap via a shaft; and wherein the piezoelectric crystal assembly is installed in the rear cap, and one end of the piezoelectric crystal assembly corresponds to a safety plate on the other side of the rear cap.

2. The hand-held aerosol fire suppression apparatus according to claim 1, wherein the safety plate is an embedded cap that can be destructed and fall off when the press bar is turned, and is installed on the rectangular opening on the other side of the rear cap.

3. The hand-held fire suppression apparatus according to claim 1, wherein the press bar has a boss on one side.

4. The hand-held aerosol fire suppression apparatus according to claim 1, wherein the concave-convex fitting between the bulge on the edge of the triangular platen and the recess in the V-shaped convex may be convex-concave fitting.

5. The hand-held aerosol fire suppression apparatus according to claim 1, further comprising a tabular coolant and a cellular coolant; the tabular coolant is arranged between the aerosol generating agent and the cellular coolant.

6. The hand-held aerosol fire suppression apparatus according to claim 2, further comprising a tabular coolant and a cellular coolant; the tabular coolant is arranged between the aerosol generating agent and the cellular coolant.

7. The hand-held aerosol fire suppression apparatus according to claim 3, further comprising a tabular coolant and a cellular coolant; the tabular coolant is arranged between the aerosol generating agent and the cellular coolant.

8. The hand-held aerosol fire suppression apparatus according to claim 4, further comprising a tabular coolant and a cellular coolant; the tabular coolant is arranged between the aerosol generating agent and the cellular coolant.

* * * * *